United States Patent [19]

Waugh et al.

[11] Patent Number: 4,716,052

[45] Date of Patent: Dec. 29, 1987

[54] METHOD OF MAKING PRESSURE SENSITIVE ADHESIVE TAG OR LABEL STOCK

[75] Inventors: Robert E. Waugh, Sun City Center, Fla.; Urban R. Nannig, North Kingstown, R.I.; Clyde R. Rockwood, Columbus, Ohio

[73] Assignee: The D. L. Auld Company, Columbus, Ohio

[21] Appl. No.: 820,270

[22] Filed: Jan. 21, 1986

[51] Int. Cl.[4] ..... B41M 3/12

[52] U.S. Cl. ..... 427/147; 427/203; 427/204; 427/205; 427/208.4; 427/208.8; 427/261

[58] Field of Search ..... 427/147, 208.4, 208.8, 427/203, 204, 197, 205, 261

[56] References Cited

U.S. PATENT DOCUMENTS

| | | | |
|---|---|---|---|
| 1,693,561 | 11/1928 | Klein | 428/31 |
| 2,021,961 | 11/1935 | MacFarlane | 427/208.4 |
| 2,354,857 | 8/1944 | Gits et al. | 29/527.4 |
| 2,376,305 | 5/1945 | Bauer | 29/527.4 |
| 3,235,396 | 2/1966 | Haberlin | 427/208.4 |
| 3,684,544 | 8/1972 | Piron | 427/147 |
| 3,843,475 | 10/1974 | Kent | 428/31 |
| 3,914,482 | 10/1975 | Sawa et al. | 428/31 |
| 3,964,906 | 6/1976 | Kenney | 96/33 |
| 3,974,311 | 8/1976 | Cherrin | 428/43 |
| 4,010,297 | 3/1977 | Wenrick | 428/31 |
| 4,044,181 | 8/1977 | Edhlund | 427/147 |
| 4,100,010 | 7/1978 | Waugh | 156/242 |
| 4,135,033 | 1/1979 | Lawton | 428/344 |
| 4,171,398 | 10/1979 | Hunt | 427/147 |
| 4,177,309 | 12/1979 | Shadbolt et al. | 427/147 |
| 4,210,693 | 7/1980 | Regan et al. | 428/152 |
| 4,220,681 | 9/1980 | Narita | 428/31 |
| 4,259,388 | 3/1981 | Reed | 428/174 |
| 4,296,155 | 10/1981 | Madonia et al. | 428/31 |
| 4,331,704 | 5/1982 | Watson, Jr. et al. | 427/54.1 |
| 4,332,074 | 6/1982 | Auld et al. | 29/527.4 |
| 4,351,686 | 9/1982 | Clark | 156/329 |
| 4,356,617 | 11/1982 | Coscia | 29/527.4 |
| 4,400,419 | 8/1983 | Laczynski | 427/147 |
| 4,409,264 | 10/1983 | Gilleo et al. | 427/265 |
| 4,446,179 | 5/1984 | Waugh | 428/31 |
| 4,460,429 | 7/1984 | Coscia et al. | 156/384 |
| 4,481,160 | 11/1984 | Bree | 244/135 |
| 4,542,052 | 9/1985 | Shadbolt et al. | 427/147 |

FOREIGN PATENT DOCUMENTS

| | | | |
|---|---|---|---|
| 618937 | 4/1961 | Canada | 427/147 |
| 58-93984 | 6/1983 | Japan . | |
| 58-136078 | 10/1983 | Japan . | |
| 58-192679 | 12/1983 | Japan . | |

*Primary Examiner*—Janyce A. Bell

*Attorney, Agent, or Firm*—Killworth, Gottman, Hagan & Schaeff

[57] ABSTRACT

A method of making a pressure sensitive adhesive stock material for tags or labels is provided which eliminates the need for a self-supporting paper, cardboard, or plastic substrate. A layer of pressure sensitive adhesive is provided, preferably on a release liner. The upper surface of the adhesive is then treated to render it substantially tack free and suitable for printing directly thereon.

7 Claims, 1 Drawing Figure

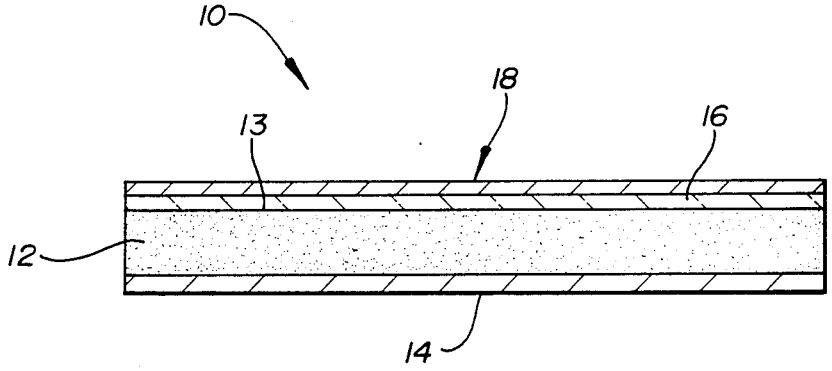
10
18
13
16
12
14

METHOD OF MAKING PRESSURE SENSITIVE ADHESIVE TAG OR LABEL STOCK

BACKGROUND OF THE INVENTION

This invention relates to making stock for tags, labels, and the like, and more particularly to a method of manufacturing pressure sensitive adhesive label stock in which indicia may be printed directly onto a detackified surface of a layer of pressure sensitive adhesive.

Various types of adhesive tags, labels, and the like have been heretofore available. Those tags having a pressure sensitive adhesive backing generally are mounted on some type of release liner or other releasable support to protect the pressure sensitive adhesive until the tag is ready to be applied to an intended substrate. The tag is then stripped from the release liner and applied.

Typically, such tag or label stock is a web or sheet of paper, cardboard, or plastic onto one major face of which a pressure sensitive adhesive is applied. Such stock is self-supporting and is typically printed on its other major face with information or other indicia either before or after the application of adhesive to the first major face.

In the manufacture and production of pressure sensitive adhesive tags or labels a substantial portion of the overall cost involved is in the material costs for the stock, be it paper, cardboard, or plastic. Additionally, where the tag or label is to be adhered to a contoured or irregular surface, and where a high degree of flexibility is desired, the rigidity of the stock may interefere with the application and adherence of the tag or label.

Accordingly, the need exists in the art for a relatively inexpensive process to manufacture tag or label stock for pressure sensitive adhesive tags and labels which is highly flexible and conforms to contoured or irregular surfaces.

SUMMARY OF THE INVENTION

The present invention meets that need by providing a method of making stock, either in sheet or roll form, for a pressure sensitive adhesive tag or label which avoid the need for a self-supporting paper, cardboard, or plastic layer. In accordance with one aspect of the present invention, tag or label stock is made by the steps of providing a layer of pressure sensitive adhesive material and treating a first surface of that pressure sensitive adhesive to render that surface substantially tack free and suitable for the printing of information or other indicia directly thereon.

In a preferred embodiment of the invention, the pressure sensitive adhesive layer is supported on a release liner or other releasable surface. The adhesive may be applied to the release liner in a conventional manner such as by spraying or roll coating. The adhesive may be clear or colored to provide a background for information or indicia printed thereon.

The first surface of the pressure sensitive adhesive may be detackified and rendered printable by coating or spraying it with a hardenable or curable liquid, by coating with particulate material, by coating with a hot stamp foil, or by spray metallizing the surface. The thus treated first (upper) surface of the adhesive is then printed or otherwise decorated by silkscreening or other conventional printing techniques.

The stock material may be made in either sheet or roll form. The printed stock having a plurality of tags or labels thereon may then be shipped or sold to the user where individual tags or labels may be readily peeled off of the release liner, in sheet or roll form, and are ready to be adhered to an intended surface. The individual tags or labels may also be die cut from a larger sheet or web, with release liner attached, and used in that manner.

The present invention thus provides a stock material for tags or labels without the need for the paper, cardboard, or plastic substrate required by the prior art. The present invention also provides an extremely flexible tag or label which conforms and adheres well to contoured and irregular surfaces. Accordingly, it is an object of the present invention to provide a method of making such substrateless tag or label stock. This, and other objects and advantages of the invention will become apparent from the following detailed description, the accompanying drawing, and the appended claims.

BRIEF DESCRIPTION OF THE DRAWING

The single drawing FIGURE is a cross-sectional side view of tag or label stock produced by the practice of the present invention.

DETAILED DESCRIPTION OF THE PREFERRED EMBODIMENTS

The single drawing FIGURE illustrates, in cross-section, tag or label stock produced in accordance with the present invention. Stock article 10 has a layer of pressure sensitive adhesive 12 having a first upper surface 13 and a second lower surface. Pressure sensitive adhesive 12 can be any of a number of commercially available adhesives such as, for example, an acrylic pressure sensitive adhesive. The lower surface of adhesive 12 is adhered to a release liner 14 or other releasable support surface. Liner 14 is preferably coated with a release material such as a silicone-based polymer which permits ready removal of article 10 when it is desired to adhere article 10 to an intended substrate. Of course, other known release agents may also be utilized on liner 14.

Adhesive 12 may be applied to liner 14 by any suitable means such as by spraying or roll or dip coating. Preferably, adhesive layer 12 is applied in a thickness of from between about 0.002 to 0.010 inches.

The adhesive 12 is then treated to render the upper surface 13 of the adhesive substantially tack free and suitable for printing indicia 18 directly thereon. The lower surface of adhesive 12 remains tacky so that the finished article may be adhered to an intended surface. The treatment of upper surface 13 of adhesive 12 to render is substantially tack free and suitable for printing directly thereon may be accomplished by a number of different procedures such as coating, spraying, or extruding with a hardenable or curable liquid material such as a lacquer or transparent polymer resin, coating with a particulate material, hot stamping with a metal foil, spray metallizing, application of a cross-linking agent to the surface of the adhesive, or the application of heat or light energy (e.g., ultraviolet light) to cross-link the surface of the adhesive. All of these treating procedures produce a nonself-supporting surface 16 which is substantially tack free and printable.

In one preferred procedure, upper surface 13 of adhesive 12 is overcoated with a thin layer of a transparent, clear or colored lacquer which forms non-tacky surface 16 and seals the upper surface of the adhesive. Alternatively, upper surface 13 may be dusted with a fine particulate material of inert particles such as mica or talc. Upper surface may also have a thin curable liquid polymer resin applied thereto by coating, spraying, or extruding.

In yet another alternative procedure, a bright metallic surface may be applied to upper surface 13. This can be accomplished by applying a bright metal hot stamp foil to upper surface 13 by means of a pressure roll or the like. The foil is accompanied by a carrier film which is then stripped away leaving a bright metallic non-tacky and printable surface 16. The metallic surface may be gold, silver, or chrome colored, or other colors may be used as desired. The overall thickness of the bright metallic surface is desirably 0.001 inches or less.

Once upper surface 13 has been treated and rendered substantially tack-free, any suitable indicia 18 may be printed directly thereon. Of course, the end user of the stock tag or label may do the printing himself by a machine or hand process. These printable indicia may include letters, numbers, words, symbols, pictures, or other decoration. The printing may be accomplished by any of a number of printing techniques which are known in the art, including silkscreen printing. Optionally, indicia 18 may be overcoated with a clear, transparent, protective coating of a polymer resin such as an acrylic resin.

Adhesive layer 12 may itself be colored by the addition of suitable pigments or dyes to the composition. If layer 12 is already colored, the need for overprinting a colored background may be eliminated. Likewise, if layer 12 is clear, areas of the upper surface of the adhesive may be left undecorated by indicia 18 so that when the tag or label is applied to a substrate, the color or brightness of the substrate shows through in those areas.

In one method of manufacture, a plurality of individual tags or labels may be supported on a single layer sheet, roll, or web or release liner 14. All of the steps in the manufacturing procedure may be performed on the larger sheet, roll, or web. Individual tags or labels may then be die cut, stamped out, or otherwise separated from the larger sheet. In one embodiment the individual tags or labels may be kiss-cut (i.e., cut through to release liner 14) and left on the larger sheet or roll. In this manner, they may be shipped to ultimate users who may then readily peel the individual articles from release liner 14 for adherence to intended substrates. It will be apparent that tags, labels, or the like of any shape or size may be formed including squares, rectangles, circles, ovals, and the like.

In the practice of the present invention, a unique substrateless (i.e., meaning that there is no self-supporting paper, cardboard, or plastic stock as such) article is produced which is useful as tag or label stock and may be readily printed. Additionally, the articles produced by the practice of the present invention may be used as base stock material for plastic capped emblems, trim strips, and other decorative articles as described in commonly-assigned copending U.S. applications Ser. Nos. 744,014 and 744,128, both filed June 12, 1985. Additionally, articles produced by the practice of the present invention may find use as pressure sensitive adhesive decals and the like.

Having described the invention in detail and by reference to preferred embodiments thereof, it will be apparent that modifications and variations are possible without departing from the scope of the invention defined in the appended claims.

What is claimed is:

1. A method of making stock for a tag, label, or the like comprising the steps of:

(a) providing a layer of pressure sensitive adhesive, (b) treating a first surface of said pressure sensitive adhesive by the application of a inert particulate material to render said first surface substantially tack free and suitable for printing directly thereon, and (c) printing indicia directly on said substantially tack free first surface of said pressure sensitive adhesive.

2. The method of claim 1 including the step of supporting said adhesive on a release liner.

3. The method of claim 1 in which said adhesive is colored and provides a colored background for said indicia printed thereon.

4. The method of claim 1 in which said particulate material is mica.

5. The method of claim 1 in which said particulate material is talc.

6. The method of claim 1 including the step of overcoating said printed indicia with a transparent polymer resin.

7. The method of claim 6 in which said polymer resin is an acrylic resin.

* * * * *